US007185864B2

(12) United States Patent
Adams

(10) Patent No.: US 7,185,864 B2
(45) Date of Patent: Mar. 6, 2007

(54) DOOR HOOK WITH HINGE

(75) Inventor: William E. Adams, Harmony, PA (US)

(73) Assignee: Adams Mfg. Corp., Portersville, PA (US)

( * ) Notice: Subject to any disclaimer, the term of this patent is extended or adjusted under 35 U.S.C. 154(b) by 56 days.

(21) Appl. No.: 10/676,924

(22) Filed: Oct. 1, 2003

(65) Prior Publication Data

US 2005/0072886 A1 Apr. 7, 2005

(51) Int. Cl.
*A47F 3/00* (2006.01)
*A47F 5/00* (2006.01)
*A47H 1/10* (2006.01)

(52) U.S. Cl. ..... 248/301; 248/215; 248/304; 248/308

(58) Field of Classification Search ..... 248/301, 248/398, 215, 304, 308; 211/118, 116
See application file for complete search history.

(56) References Cited

U.S. PATENT DOCUMENTS

| | | | | | |
|---|---|---|---|---|---|
| 1,474,660 | A | | 11/1923 | White | |
| 1,540,556 | A | | 6/1925 | Laurie | |
| 1,856,847 | A | * | 5/1932 | Gates | 248/231.81 |
| 2,565,719 | A | * | 8/1951 | Church | 248/215 |
| 3,536,286 | A | | 10/1970 | Kramer | |
| 4,034,865 | A | | 7/1977 | Batts et al. | |
| 4,128,918 | A | * | 12/1978 | Wenk | 24/16 R |
| 4,817,239 | A | | 4/1989 | Campbell et al. | |
| 5,087,007 | A | | 2/1992 | Gaderick | |
| D326,021 | S | | 5/1992 | Evenson | |
| D340,672 | S | | 10/1993 | Adams | |
| D342,889 | S | | 1/1994 | Adams | |
| 5,413,297 | A | | 5/1995 | Adams | |
| 5,535,971 | A | | 7/1996 | Adams | |
| 5,553,823 | A | | 9/1996 | Protz, Jr. | |
| D374,168 | S | | 10/1996 | Protz, Jr. | |
| 5,782,090 | A | * | 7/1998 | Locke | 60/397 |
| D422,198 | S | | 4/2000 | Snell | |
| 6,073,899 | A | * | 6/2000 | Omrani | 248/311.2 |
| 6,082,686 | A | * | 7/2000 | Schumann | 248/205.3 |

(Continued)

OTHER PUBLICATIONS

Photocopy of mainstays™ décor Over Door Hook on blister card which is commercial embodiment of U.S. Patent No. Des. 479,918.

*Primary Examiner*—Amy J. Sterling
(74) *Attorney, Agent, or Firm*—Buchanan Ingersoll PC

(57) ABSTRACT

A door hook including a U-shaped bracket having a top member and front and back sides attached to the top member. The front and back sides are separated by a first distance, which corresponds generally to the thickness of a door over which the door hook is to be placed. A J-hook is attached to the front side, while a spacing member is attached to the back side or top. A hinge element is formed in the back side or top such that the spacing member is pivotable toward a position under the top member. With the spacing member in this position, the spacing member and the front side are separated by a second distance, less than the first distance, which corresponds generally to the thickness of a thinner, second door over which the door hook may be placed. In this manner, the door hook may be easily adjusted to fit over doors having different thickness, such as, for example, exterior and interior doors.

16 Claims, 5 Drawing Sheets

U.S. PATENT DOCUMENTS 6,152,416 A * 11/2000 Jacob ..... 248/441.1
6,224,030 B1 5/2001 Hepworth
6,302,365 B1 10/2001 Catanzarite et al.
6,305,054 B1 * 10/2001 Imes et al. ..... 24/276
6,311,851 B1 11/2001 Knudsen, Sr. et al.
D455,947 S 4/2002 Goodman et al.
6,540,121 B1 * 4/2003 Harvey ..... 223/85
D479,981 S 9/2003 Snell

* cited by examiner

DOOR HOOK WITH HINGE

FIELD OF THE INVENTION

The present invention is directed toward over-the-door hooks and, more particularly, toward an over-the door hook capable of being used with doors having different thickness.

BACKGROUND OF THE INVENTION

There are a variety of hooks that fit over the top of a door. One common type of hook has a U-shaped bracket having an opening not greater than the thickness of the door to which it is to be attached. One or more hooks extends from either or both sides of the bracket. Examples of this type of door hook are disclosed in U.S. Pat. No. 4,817,239 to Campbell et al. and U.S. Pat. No. 6,302,365 to Catanzarite et al. and U.S. Design Pat. No. 342,889 to Adams, Des. 422,198 to Snell and Des. 455,947 to Goodman et al. These door hooks are made of plastic or metal and are unitary structures. One shortcoming of this type of hook is that the bracket is sized to fit doors having the same thickness or a slightly smaller thickness as the opening in the bracket. The hooks are not adjustable either in the width of the bracket or the level at which the hook portion is positioned relative to the top of the door. Consequently, the art has recognized a need for an over-the-door hook that will fit over a wider range of door thickness.

One type of over-the-door hook that will fit a wider range of doors is disclosed in U.S. Pat. No. Des. 326,021 to Evenson. That door hook has two L-shaped members that fit together in a manner to form an adjustable U-shaped hook. The two L-shaped members are connected by a tongue and groove type joint that enables them to slide apart from and toward one another thereby changing the width of the hook. A significant shortcoming of this hook is the thickness of that portion of the hook that fits on top of the door. That thickness prevents many doors from being tightly closed. Another approach to providing a door hook that fits over a wider range of door thickness is to provide a U-shaped bracket in which the legs of the bracket angle toward one another and can flex away from one another. This type of hook is disclosed in my U.S. Pat. No. Des. 342,889. This type of hook is more likely to jam and to slide and be pulled off the door than is a door hook having the bracket with an opening that is the same as the thickness of the door. The hook must be thick enough to allow the plastic to fill the entire mold cavity. That thickness coupled with the excess width of the top of the bracket beyond the thickness of the door creates this problem.

In designing an over-the-door hook, the objective has always been to create an inexpensive hook that will fit the door while that door is open or closed and that will hold significant weight. When the door is open, a door hook with too wide a top tends to slide and be pulled off the door. Clear plastics are often used because they are cheaper than metal and less noticeable. But, it is very difficult to mold thin sections of plastic because plastic does not flow well through thin openings. Consequently, plastic door hooks have been over 0.080 inches thick and many are 0.125 inches thick. Many of these door hooks are too thick to close a door safely without damaging the door. This is particularly true of newer doors that have tight seals between the door and the jamb. The thicker door hooks have, in many cases, actually weakened the very hinges that hold the door, and also compressed and damaged wood in both the door and the jamb. If the over-the-door hook is too thick, the door may not close or when it does close it may not latch. Locks and latches on the door may be forced downward so that they no longer engage openings in the jamb. To avoid this problem the top of an over the door hook should be no more than 0.080 inches thick.

There is a need for an over-the-door hook which can hold significant weight when the door is open, and which permits the door to be closed without damaging the door and which is or can be configured to securely fit over exterior doors which may be typically two inches wide and thinner interior doors which may be 1⅜ to 1¾ inches wide.

SUMMARY OF THE INVENTION

A door hook is provided according to the present invention including a U-shaped metal or plastic bracket having a top member and front and back sides attached to the top member. The front and back sides are separated by a first distance, which corresponds generally to the thickness of the thickest door over which the door hook is intended to be placed. A J-hook is attached to the front side of the U-shaped bracket, while a spacing member is attached to the back side. A hinge element is formed in the back side such that the spacing member is pivotable in a direction toward the front side from a first position to a second position. With the spacing member in its second position, the spacing member and the front side are separated by a second distance, less than the first distance, which corresponds generally to the thickness of a thinner, second door over which the door hook may be placed. In this manner, the door hook of the present invention may be easily adjusted to fit over doors having different thickness, such as, for example, exterior and interior doors.

In one form of the present invention, the spacing member includes a J-hook attached to the back side. The J-hook pivots between the first and second positions to allow the door hook to be placed on doors having different thickness. In this embodiment, the J-hook pivots 180° from the first position to the second position. Alternatively, the J-hook could be removed from the back side and reattached to the back side at the second position.

The front side of the U-shaped bracket is preferably angled inwardly toward the back side. Similarly, the back side of the U-shaped bracket is also preferably angled inwardly toward the front side. The acute angles between the front side and the top member and/or between the back side and the top member increase the holding power of the door hook but are not required.

In another form of the present invention, an additional J-hook is attached to the back side of the U-shaped bracket. The additional J-hook is positioned between the top member and the hinge element, such that the additional J-hook can be utilized for holding an article with the spacing member either in its first or second position.

In a further form of the present invention, the spacing member includes first, second and third hook members attached to the back side of the U-shaped bracket and positioned in side-by-side relationship, with the first and third hook members positioned on opposite sides of the second hook member. The hinge element is formed in the back side such that either the second hook member or the first and third hook members are pivotable between the first and second positions.

In yet a further form of the present invention, the first, second and third hook members are independently pivotable between the first and second positions. Each of the first, second and third hook members includes a J-hook having a vertical leg portion integral with a curved portion which extends all the way to another vertical leg portion to form the J-hook. The vertical leg portions of the first and second hook members are spaced a third distance from one another, while the vertical leg portions of the second hook member are spaced a fourth distance from one another. In this manner, the first and third hook members may be pivoted to the second position to allow the door hook to securely fit over a door having a certain thickness. Alternately, the second hook member may be pivoted to the second position to allow the door hook to snugly fit over a door having a different thickness.

In still a further form of the present invention, the first, second and third hook members are molded as a separate piece from the U-shaped bracket and are snapped or otherwise attached onto the back side of the U-shaped bracket via cooperating connecting elements. Other types of attached spacers, for example, extensions on the outward edge or edges of the back side or top of the U-shaped bracket, could be folded inward to provide the desired spacing, or folded outward to form a hook, knob, or other fastening shape.

The U-shaped bracket may be made of polycarbonate, polypropylene, styrene, metal, or other hard, resilient material. Preferably, the top member is approximately 0.050 to 0.080 inches thick to fit between the door top and door jamb.

It is an object of the present invention to provide a door hook that is thin enough to fit between the top of the door and the jamb, and that is strong enough to hold significant weight, such as a decorative wreath, when the door is open.

It is an additional object of the present invention to provide a door hook that is capable of being easily adjustable to fit securely over door tops of different thickness.

Other objects, aspects and advantages of the present invention can be obtained from a study of the specification, the drawings, and the appended claims.

DETAILED DESCRIPTION OF THE INVENTION

Figure 2:
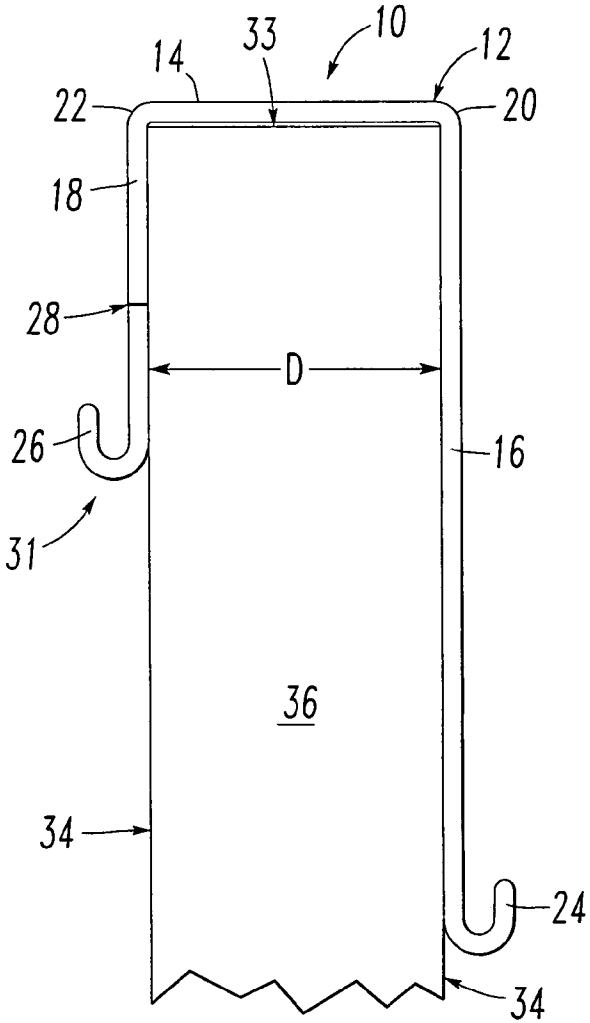
FIG. 2 is a side view of the door hook shown in FIG. 1 secured over a door having a first thickness.
Figure 1:
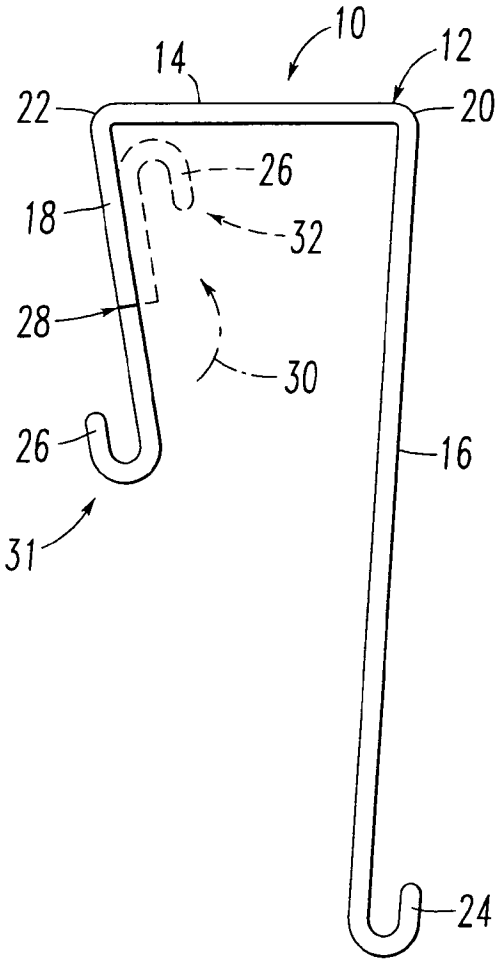
FIG. 1 is a side view of a first embodiment of a door hook according to the present invention.
Figure 3:
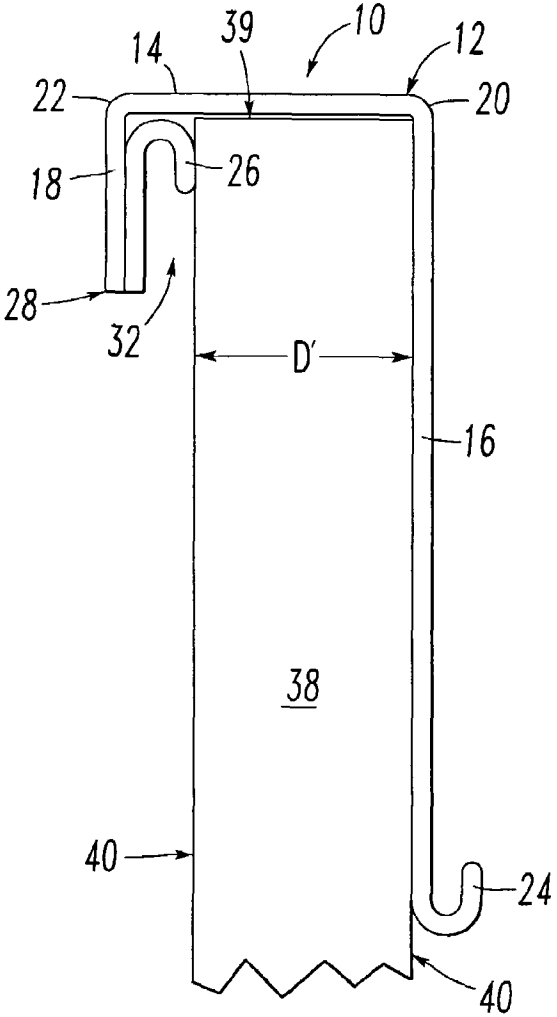
FIG. 3 is a side view of the door hook shown in FIG. 1 secured over a door having a second thickness less than the first thickness.

A first embodiment of my over-the-door hook 10 is illustrated in FIGS. 1, 2, and 3. The door hook 10 includes a U-shaped bracket 12 having a top member 14, a front side 16 and a back side 18. The front side 16 is attached to one edge 20 of the top member 14, preferably at an acute angle relative to the top member 14. The back side 18 is attached to an edge 22 of the top member 14 opposite the edge 20 attached to the front side 16. The back side 18 is also preferably attached at an acute angle relative to the top member 14. A hook 24, such as a J-hook, is attached to the front side 16, typically at an end thereof. Similarly, a hook 26 such as a J-hook, is attached to the back side 18, also typically at an end thereof.

The front side 16 and the back side 18 should be at least 1.375 inches long, and the distance between the front side 16 and the back side 18 should be about the same as the thickness of the thickest door on which the hook 10 may be placed. This combination of length and width prevents the bracket 12 from being easily pulled off the door. When one of the front and/or back sides 16, 18 is less than 1.375 inches in length, a wreath or other object of similar weight hung on the other side will pull the hook 10 from the door. Similarly, when the hook 10 is wider than the thickness of the door, it is more easily dislodged by a wreath or other object hung on the hook 10. Therefore, the distance between the front side 16 and the back side 18 at the top should be equal to, or not more than 0.025 inches greater than, the thickness of the door.

The bracket 12 may be made of a hard, resilient polymer material, such as styrene, polypropylene or polycarbonate. Additionally, the bracket 12 may be made of materials such as Lexan, K-resin or metal (brass, stainless steel, etc.) without departing from the spirit and scope of the present invention. The top member 14 is preferably 0.050 to 0.080 inches thick to fit between a vast majority of door tops and jambs. When an object is held on the hook 24, the front side 16 is pulled downward by the weight of the object. The downward force is likely to lift the back side 18 and the top member 14 of the door hook 10. However, the acute angle between the front side 16 and the top member 14 increases the holding power of the door hook 10 and helps to keep the door hook 10 from being lifted. The acute angle between the back side 18 and the top member 14 also increases the holding power of the door hook 10, and provides the same advantages as previous described when an object is held on the hook 26. The acute angle between the front and back sides and the top member also provides a sung fit on those doors whose thickness is slightly less than the standard size for that type of door. It is preferred that the angle between the front side 16 and top member 14 and between the back side 18 and top member 14 be approximately 85-degrees; however, other angular displacements or straight sides may be utilized without departing from the spirit and scope of the present invention.

The back side 18 includes a hinge element 28 formed therein. The hinge element 28 allows the hook member 26 to pivot in a direction toward the front side 16, as shown by arrow 30 in FIG. 1, from a first position (shown at 31) to a second position (shown at 32 in dotted form). Preferably, the first and second positions are 180° apart. However, other angular displacements may be utilized between the first and second positions without departing from the spirit and scope of the present invention.

In FIG. 2, the door hook 10 of the present invention is positioned over a door 36 having a door top 33 from which sides 34 extend. The door hook 26 is in the first position 31 and the front 16 and back 18 sides are separated by a first distance D, which corresponds generally to the thickness of the door 36. Thus, the door hook 10 of the present invention is able to fit snugly over the door 36.

As shown in FIG. 3, with the hook 26 pivoted to the second position 32, the door hook 10 of the present invention is capable of being snugly fit over a door 38 having a thickness that is less than the thickness of the door 36 in FIG. 2. With the hook 26 pivoted to the second position 32, the front side 16 and the hook 26 are separated by a second distance D', which corresponds generally to the thickness of the door 38. With the door hook 10 positioned over the door top 39, the hook 26 and front side 16 fit snugly against the sides 40 of the door 38 to securely fit the door hook 10 to the door 38. Thus, the door hook 10 may be easily implemented for use with doors having different thickness. For example, the door 36 shown in FIG. 2 could be an exterior door, while the door 38 shown in FIG. 3 could be an interior door. Generally, exterior doors are thicker than interior doors. The hook 26 is sized such that with the hook 26 in the second position 32, the distance between the hook 26 and front side 16 would correspond to the thickness of an interior door. If the hook 26 is made of a flexible material the distance between the tip of hook 26 and front side 16 may be less than the thickness of door 36, when the hook is in the position shown by the dotted lines in FIG. 1 and not placed on door 36. The top of hook 26 should have a slight curve inward to make it easier to pull the door hook 10 down over the door when hook 26 is in the folded position. One may provide double sided tape on the back surface of back side 16 or some other locking device to keep hook 26 in the folded position shown in FIG. 3.

It should be understood that while the hook 26 has been shown and described as being pivotable between the first position 31 and second 32 position, a differently shaped hook or other spacing member having an appropriate shape and thickness may be utilized in place of hook 26 to allow the door hook 10 to securely fit on doors having different thickness by folding a portion of the back side of the hook. For example, hook 26 may be L-shaped or a loop. A hemispherical shape may replace the curved hook 26. Any shape which provides the desired spacing may be used.

The resulting position of the J-hook shown in dotted line in FIG. 1 could also be obtained by detaching the J-hook from the back side and reattaching the J-hook to the back side at the position shown in dotted line in FIG. 1. The break could be made at the location of the hinge 28 or along a score line provided on the back side. The removed J-hook could be reattached using double sided tape on the back surface of the back side 16 or by some other locking device. Other locking devices may include a tongue and groove, mating slots or other arrangement commonly used to joint two plastic or metal parts.

Figure 4:
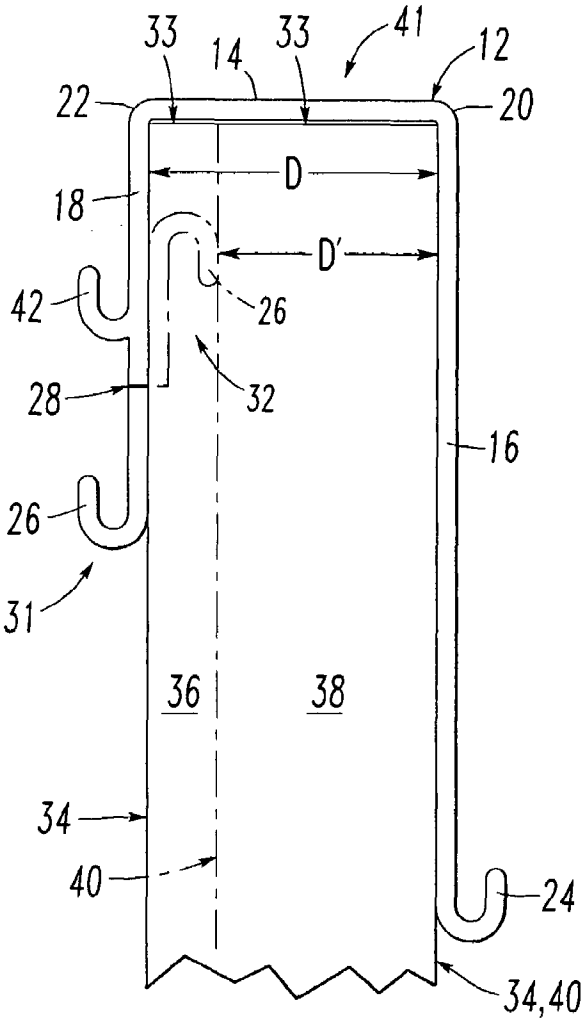
FIG. 4 is a side view of a second embodiment of a door hook according of the present invention secured over a door.

A second embodiment of the present invention is shown in FIG. 4 generally at 41, with like elements of FIGS. 1–3 indicated with the same reference numbers. An additional hook member 42 is attached to the back side 18 of the U-shaped bracket 12. The additional hook member 42 is positioned such that it is between the hinge 28 and the edge 22 of the top member 14. In this particular embodiment, with the hook 26 in the first position 31, the door hook 41 may be snugly fit over the door 36 having a thickness corresponding to the distance D between the front 16 and back 18 sides. Additionally, with the hook 26 pivoted to the second position 32, the door hook 41 may be snugly fit over the door 38 having a thickness corresponding to the distance D' between the hook 26 and the front side 16. In either case, objects may still be attached to the hook 42 provided on the back side 18.

Figure 5:
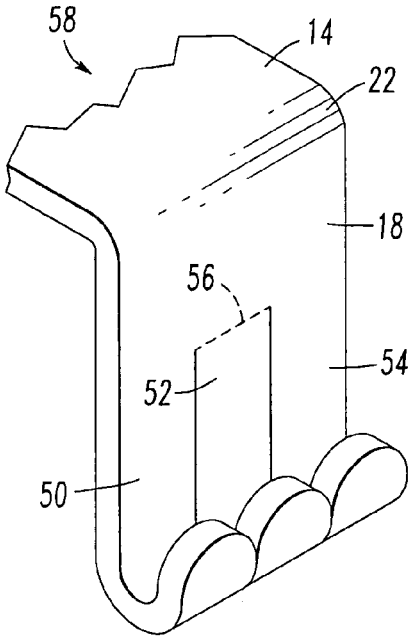
FIG. 5 is a partial perspective view of a third embodiment of a door hook according to the present invention.
Figure 6:
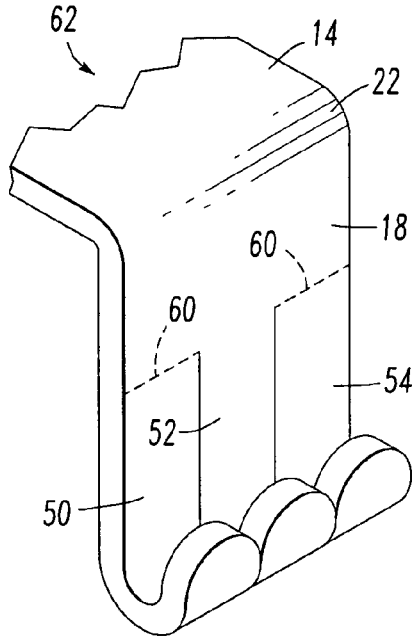
FIG. 6 is a partial perspective view of a fourth embodiment of a door hook according to the present invention.

FIGS. 5 and 6 illustrate further embodiments of the door hook according to the present invention, with like elements of FIGS. 1–3 indicated with the same reference numbers. For clarity, the front side 16 of the U-shaped bracket 12 has been omitted from FIGS. 5 and 6. In these embodiments, the hook 26 is replaced by first 50, second 52 and third 54 hook members, positioned in side-by-side relationship. Referring to FIG. 5, a hinge element 56 is formed in the back side 18 allowing the second hook member 52 to pivot between the first and second positions, as previously described. The first 50 and third 54 hook members are generally non-pivotable. In this particular embodiment, only the second hook member 52 is pivotable between the first and second positions for attaching the door hook 58 of FIG. 5 to doors of different thickness, while the first 50 and third 54 hook members remain available for attachment of objects thereto.

In a slightly different embodiment, shown in FIG. 6, hinge elements 60 are provided in the back side 18 such that the first 50 and third 54 hook members are pivotable between the first and second positions, as previously described. Generally, the second hook 52 member is non-pivotable. Thus, while the first 50 and third 54 hook members are pivotable between the first and second positions to snugly fit the door hook 62 shown in FIG. 6 over doors having different thickness, the second hook member 52 remains available for attachment of objects thereto.

Figure 7:
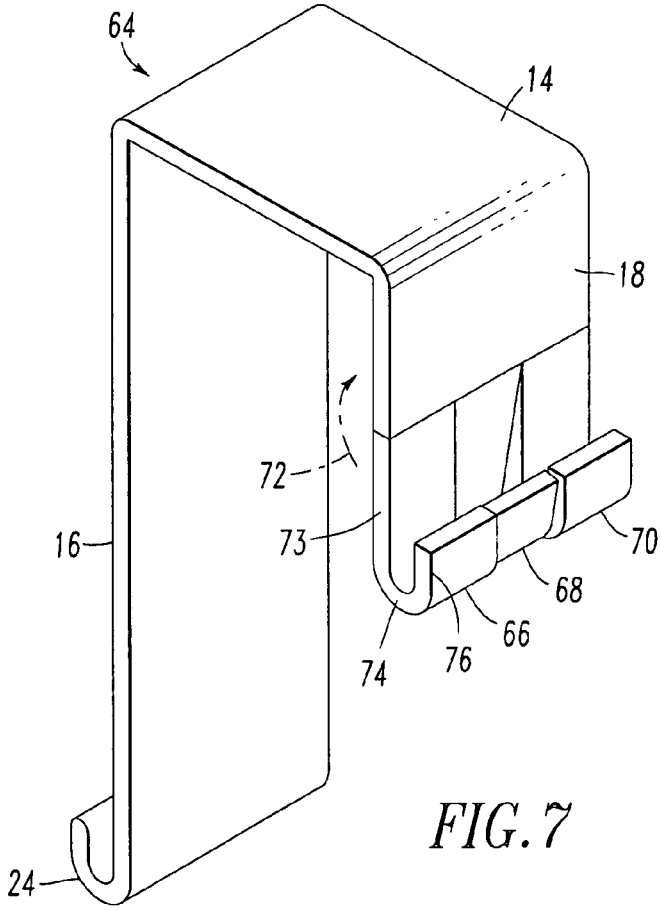
FIG. 7 is a perspective view of a fifth embodiment of a door hook according to the present invention.

FIG. 7 illustrates yet a further embodiment of the door hook according to the present invention, shown generally at 64, with like elements of FIGS. 1–3 indicated with the same reference numbers. As shown in FIG. 7, the back side 18 includes a plurality of hook members 66, 68 and 70 attached thereto. A hinge element 71 is formed on the back side 18 and allows each of the hook members 66, 68 and 70 to independently pivot in a direction toward the front side 16, as shown by arrow 72, from the first position to the second position, as previously described.

Each of the hook members 66, 68 and 70 includes a vertical leg portion 73 integral with a curved portion 74 which extends all the way to another vertical leg portion 76, forming a J-hook type structure. The distance between the vertical leg portions 73 and 76 on the hook members 66 and 70 is preferably set to a first distance, while the distance between the vertical leg portions 73 and 76 on the hook member 68 is preferably set to a second distance. Consequently, the opening or mouth of hook member 68 is different, illustrated in FIG. 7 as smaller than, the opening or mouth of hook members 66 and 67. In this manner, with hook members 66 and 70 pivoted to the second position, the door hook 64 may be snugly fit on doors having a first thickness substantially equal to the distance between the front 16 and back 18 sides minus the distance between the leg portions 73 and 76 of the hook members 66 and 70. Similarly, with the hook member 68 pivoted to the second position, the door hook 64 may be snugly fit on doors having a second thickness substantially equal to the distance between the front 16 and back 18 sides minus the distance between the leg portions 73 and 76 of the hook member 68. Any desired number of hooks could be provided to accommodate doors of different thickness.

While most exterior doors are about 1¾ inches thick, many interior doors are two inches thick. Interior doors are usually 1⅜ inches in thickness. Therefore, I prefer to provide a distance between the front 16 and back 18 sides of the door hook 64 of 2". The distance between the vertical leg portions 73 and 76 of the hook members 66 and 70 may be set to ⅝". The distance between the vertical leg portions 73 and 76 of the hook member 68 may be set to ¼". Accordingly, with the hook members 66, 68 and 70 pivoted to the first position, the door hook 64 may be snugly fit on doors having a thickness approximately equal to 2". With the hook members 66 and 70 pivoted to the second position, the door hook 64 may be snugly fit on doors having a thickness approximately equal to 1⅜" (2" minus ⅝"). Further, with the hook member 68 pivoted to the second position, the door hook 64 may be snugly fit on doors having a thickness approximately equal to 1¾" (2" minus ¼"). It should be understood that the various distances set forth herein are for exemplary purposes only, and other vertical leg portion spacing and/or number of hook members may be utilized without departing from the spirit and scope of the present invention.

Figure 8:
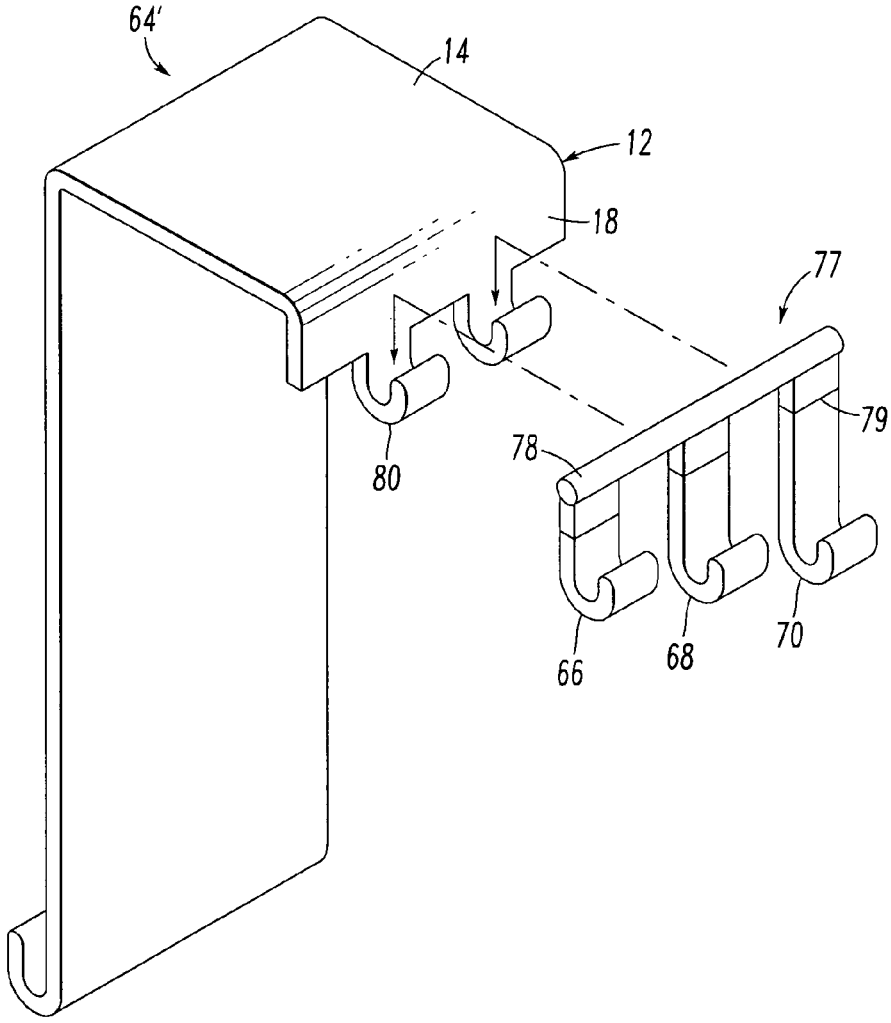
FIG. 8 is a perspective view of a sixth embodiment of a door hook according to the present invention.

In a slightly different embodiment, as shown in FIG. 8, the door hook 64' illustrated therein may be molded as two separate pieces, with a hooking element 77, including the hook members 66, 68 and 70, molded separately from the U-shaped bracket 12. Each of the hook members 66, 68 and 70 extends from a connecting element 78 and includes a hinge element 79 allowing the respective hook member 66, 68 and 70 to independently pivot between the first and second positions, as previously described. The back side 18 includes connecting projections 80 which are received into the open spaces between the hook members 66, 68 and 70 allowing the separate hooking element 77 to snap onto the back side 18 of the U-shaped bracket 12 via the cooperating connecting element 78 and projections 80. The embodiment shown in FIG. 8 allows for separate hooking elements 77 having hook members with different distances between their vertical leg portions to be interchanged on the door hook 64'. This allows the door hook 64' to be utilized with an even greater variety of doors having an even greater variety of thickness simply by changing the hooking element 77. The embodiment of FIG. 8 is easier to mold and can be made in a less expensive mold than the embodiments of FIGS. 5 and 6.

Figure 9:
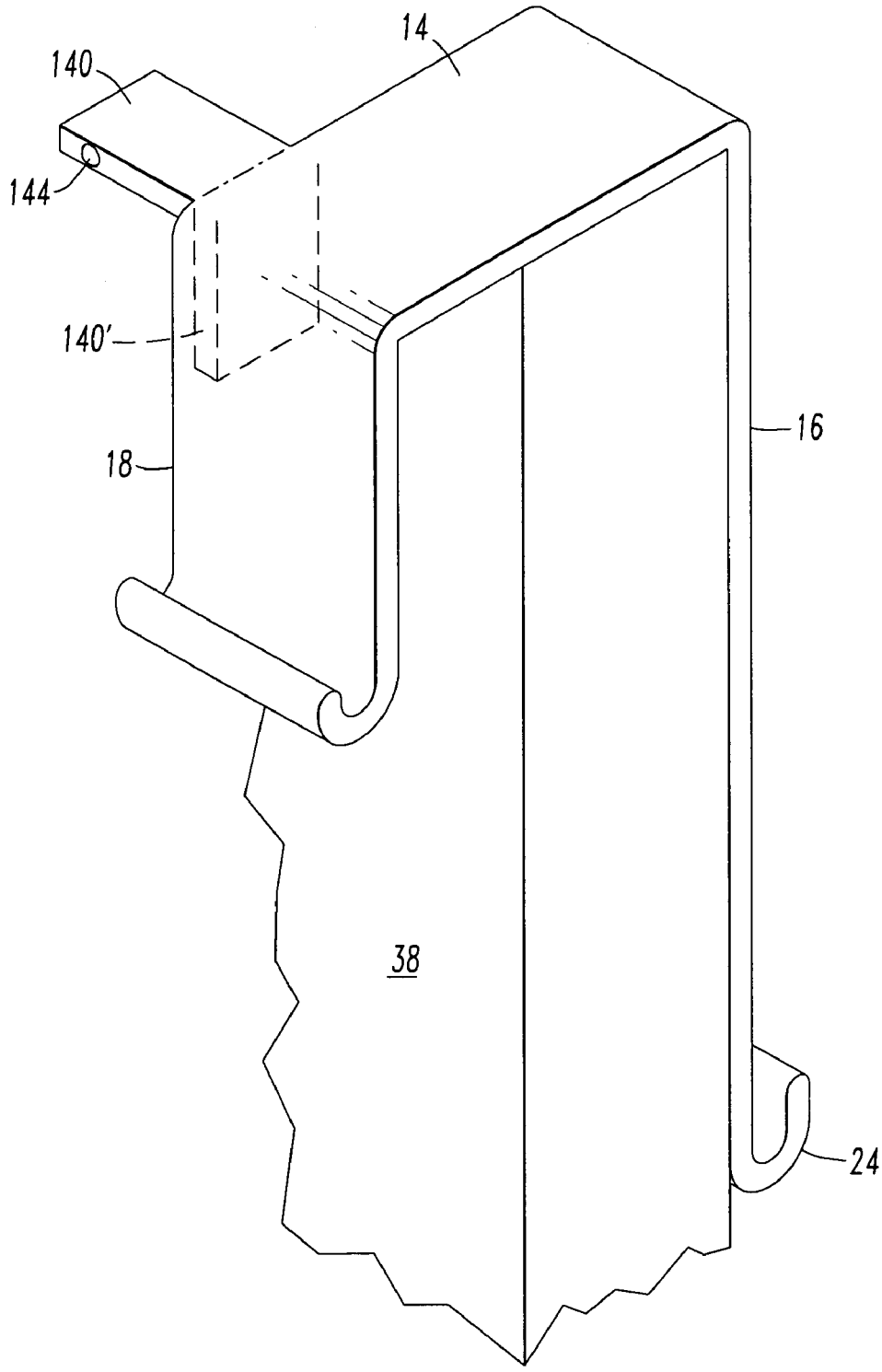
FIG. 9 is a perspective view of a seventh embodiment of a door hook according to the present invention.

While I prefer to provide the hinge and spacing member on the back side of the door hook, these elements could be part of the top. In the embodiment shown in FIG. 9, the top 14 is molded to have a wing 140 extending from one or both edges of the top. Only one wing is shown in FIG. 9 for ease of illustration. A hinge 142 is provided to enable the wing 140 to be folded to a position 140' under the top 14 and act as a spacer between door 38 and back 18. A projection 144 is provided on the edge of wing 140 which will seat in a recess (not shown) on the back surface of the back side 18 of the door hook keeping the wing in the folded position 140'. Wing 140 may be one solid piece as shown in FIG. 9 or may have multiple independently foldable sections like the hook members 66, 68 and 70 of the embodiment shown in FIG. 7. Alternatively, one or more wings could be attached to the back side and be folded under the top member to provide the desired spacing.

In all of the illustrated embodiments the hinge is a living hinge made by molding, scoring or cutting a groove in the back of the door hook. It should be recognized that the back could be two separate pieces connected by any type conventional hinge. Such hinges include not only those having two leaves connected by a pin, like a door hinge, but also a strip of tape or other flexible material joining the two pieces together.

While the present invention has been described with the particular reference to the drawings, it should be understood that various modifications could be made without departing from the spirit and scope of the present invention. Accordingly, the invention is not limited to the embodiments shown in the drawings, but may be variously embodied within the scope of the following claims.

I claim:

1. A door hook to be extended over a door top to both sides of a door, the door hook comprising:

a U-shaped bracket having:

a top member, a front side which is attached to one edge of the top member, and a back side which is attached to another edge of the top member opposite the one edge, wherein the front and back sides are separated by a first distance;

a first hook member attached to the front side;

a second hook member attached to the back side; and a hinge element provided in the back side such that the second hook member is pivotable in a direction toward the front side from a first position in which the back side and the second hook are in a common plane to a second position in which the second hook is substantially parallel to the back side and to the common plane of the first position, wherein with the second hook member in the second position the second hook member and the front side are separated by a second distance less than the first distance.

2. The door hook of claim 1, wherein at least one of the front and back sides are attached to the top member at an acute angle relative to the top member.

3. The door hook of claim 1, further comprising a third hook member attached to the back side and positioned between the other edge of the top member and the hinge element.

4. The door hook of claim 1, further comprising third and fourth hook members attached to the back side and positioned on opposite sides of the second hook member, wherein the third and fourth hook members are non-pivotable.

5. The door hook of claim 1, wherein the U-shaped bracket is made of one of styrene, polycarbonate and polypropylene.

6. The door hook of claim 1, wherein the top member is approximately 0.050 to 0.080 inches thick.

7. The door hook of claim 1 wherein the hinge element is a living hinge.

8. The door hook of claim 1 comprising at least one of a locking member and an adhesive on the back side which is positioned to retain the second hook member in the second position.

9. A door hook to be extended over a door top to both sides of a door comprising:

a U-shaped bracket having:

a top member, a front side which is attached to one edge of the top member the front side having an inside surface, and a back side which is attached to an other edge of the top member opposite the one edge, wherein the front and back sides are separated by a first distance, the back side having an inside surface facing the inside surface of the front side;

a first hook member attached to the front side;

a spacing member attached to the back side; and a hinge element provided in the back side such that the spacing member is pivotable in a direction toward the front side from a first position to a second position in which the spacing member abuts the inside surface of the back side and faces the inside surface of the front side, wherein with the spacing member in the second position the spacing member and the front side are separated by a second distance less than the first distance.

10. The door hook of claim 9, further comprising a second hook member attached to the back side and positioned between the other edge of the top member and the hinge element.

11. The door hook of claim 9, wherein the first and second positions of the spacing member are 180-degrees apart.

12. The door hook of claim 9, wherein at least one of the front and back sides are attached to the top member at an acute angle relative to the top member.

13. The door hook of claim 9, wherein the U-shaped bracket is made of one of styrene, polycarbonate and polypropylene.

14. The door hook of claim 9, wherein the top member is approximately 0.050 to 0.080 inches thick.

15. The door hook of claim 9, further comprising second and third hook members attached to the back side and positioned on opposite sides of the spacing member, wherein the second and third hook members are non-pivotable.

16. The door hook of claim 9, further comprising a second hook member attached to the back side, wherein the second hook member is non-pivotable, and wherein the spacing member includes first and second spacing members attached to the back side and positioned on opposite sides of the second hook member, each of the first and second spacing members being independently pivotable between the first and second positions.

* * * * *